US011493040B2

(12) United States Patent
Zou et al.

(10) Patent No.: US 11,493,040 B2
(45) Date of Patent: Nov. 8, 2022

(54) DAMPING APPARATUS FOR EXHAUST VALVE IN COMPRESSOR, EXHAUST VALVE ASSEMBLY, AND COMPRESSOR

(71) Applicant: EMERSON CLIMATE TECHNOLOGIES (SUZHOU) CO., LTD., Jiangsu (CN)

(72) Inventors: Hongwei Zou, Suzhou (CN); Xuan Liu, Suzhou (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 0 days.

(21) Appl. No.: 17/256,905

(22) PCT Filed: Jun. 21, 2019

(86) PCT No.: PCT/CN2019/092246
§ 371 (c)(1),
(2) Date: Dec. 29, 2020

(87) PCT Pub. No.: WO2020/001379
PCT Pub. Date: Jan. 2, 2020

(65) Prior Publication Data

US 2021/0277896 A1 Sep. 9, 2021

(30) Foreign Application Priority Data

Jun. 29, 2018 (CN) ..... 201810700723.0
Jun. 29, 2018 (CN) ..... 201821023368.X

(51) Int. Cl.
*F04C 18/02* (2006.01)
*F04C 29/06* (2006.01)
*F04C 29/12* (2006.01)

(52) U.S. Cl.
CPC ..... *F04C 18/0215* (2013.01); *F04C 18/0253* (2013.01); *F04C 29/065* (2013.01);
(Continued)

(58) Field of Classification Search
CPC ..... F04C 29/06; F04C 29/065; F04C 29/068; F04C 29/12; F04C 29/124; F04C 29/126;
(Continued)

(56) References Cited

U.S. PATENT DOCUMENTS 5,674,061 A * 10/1997 Motegi ..... F04C 18/0253 418/55.1
6,139,291 A * 10/2000 Perevozchikov ..... F04C 29/128 418/55.1
(Continued)

FOREIGN PATENT DOCUMENTS

CN 1566704 A 1/2005
CN 1880773 A 12/2006
(Continued)

OTHER PUBLICATIONS

International Search Report and Written Opinion of the International Searching Authority (in English and Chinese) issued in PCT/CN2019/092246, dated Aug. 29, 2019; ISA/CN.

*Primary Examiner* — Mark A Laurenzi
*Assistant Examiner* — Xiaoting Hu
(74) *Attorney, Agent, or Firm* — Harness, Dickey & Pierce, P.L.C.

(57) ABSTRACT

A damping apparatus for an exhaust valve in a compressor, an exhaust valve assembly having the damping apparatus, and a compressor using the exhaust valve assembly. The damping apparatus comprises a fixed body; the fixed body comprises an exhaust hole comprises an exhaust hole through which a compression cavity and an exhaust cavity are in fluid communication with each other; the exhaust hole comprises an inlet, an outlet, and an intermediate cavity provided between the inlet and the outlet and allowing the inlet and the outlet to be in fluid communication with each other; the intermediate cavity is configured to enable the backflow of the gas from the exhaust cavity to form a vortex
(Continued)

in the intermediate cavity. The damping apparatus has advantages of reducing the force and frequency of impacts on an exhaust valve plate, and prolonging the service life of the valve plate.

11 Claims, 8 Drawing Sheets

(52) U.S. Cl.
CPC ..... *F04C 29/12* (2013.01); *F04C 29/126* (2013.01); *F04C 2250/102* (2013.01)

(58) Field of Classification Search
CPC ..... F04C 29/128; F04C 2250/10; F04C 2250/102; F04C 18/0215–0292
See application file for complete search history.

(56) References Cited

U.S. PATENT DOCUMENTS

| | | | | |
|---|---|---|---|---|
| 9,022,756 | B2 | 5/2015 | Oh et al. | |
| 2011/0027115 | A1* | 2/2011 | Oh | F04C 29/06 418/55.1 |

FOREIGN PATENT DOCUMENTS

| | | | | |
|---|---|---|---|---|
| CN | 101983288 | A | 3/2011 | |
| CN | 202520563 | U | 11/2012 | |
| CN | 103867435 | A | 6/2014 | |
| CN | 105190041 | A | 12/2015 | |
| CN | 208416954 | U | 1/2019 | |
| EP | 3015709 | A1 | 5/2016 | |
| EP | 3015710 | A1 * | 5/2016 | F04C 23/008 |
| JP | 2011-017292 | A | 1/2011 | |

* cited by examiner

DAMPING APPARATUS FOR EXHAUST VALVE IN COMPRESSOR, EXHAUST VALVE ASSEMBLY, AND COMPRESSOR

CROSS-REFERENCE TO RELATED APPLICATIONS

This disclosure is the national phase of International Application No.PCT/CN2019/092246 titled "DAMPING APPARATUS FOR EXHAUST VALVE IN COMPRESSOR, EXHAUST VALVE ASSEMBLY, AND CPMPRESSOR" and filed on Jun. 21, 2019, which claims priorities to the following two Chinese patent applications, both of which are incorporated herein by reference: Chinese Patent Application No. 201810700723.0, titled " DAMPING APPARATUS FOR EXHAUST VALVE, EXHAUST VALVE ASSEMBLY, AND COMPRESSOR", filed with the China National Intellectual Property Administration on Jun. 29, 2018; and Chinese Patent Application No. 201821023368.X, titled "DAMPING APPARATUS FOR EXHAUST VALVE, EXHAUST VALVE ASSEMBLY, AND COMPRESSOR", filed with the China National Intellectual Property Administration on Jun. 29, 2018.

TECHNICAL FIELD

The present disclosure relates to the technical field of compressors, and in particular to a damping apparatus for an exhaust valve in a compressor. The present disclosure also relates to an exhaust valve assembly including the damping apparatus and a compressor adopting the exhaust valve assembly.

BACKGROUND

The section provides background technical information related to the present disclosure, which does not necessarily constitute the conventional technology of the present disclosure.

Generally, the market requires compressors to maintain high-efficiency operation in a large temperature range. In order to meet the demand for the diversity of compressor pressure ratios, dynamic exhaust valves (HVE) have been widely used. Among them, a dynamic valve is a one-way valve including a valve disc (moving part) and a valve plate (thrust part). When in the forward direction, the impact force of the fluid medium determines the opening of the valve. When in the reverse direction, the valve is closed to prohibit circulation. For example, a related technology scroll compressor including an exhaust valve is described. Referring to FIG. 1, FIG. 1 is a longitudinal sectional view of the scroll compressor provided with an exhaust valve. The scroll compressor (hereinafter simply referred to as "compressor") 100 may include a housing 110. The housing 110 may include a housing body 112 having a substantially cylindrical shape, a top cover 114 mounted to the top of the housing body 112, and a bottom cover 116 mounted to the bottom of the housing body 112. The housing 110 defines the internal volume of the scroll compressor 100. In addition, a partition 119 may be provided in the housing 110, which enables the partition 119 and the top cover 114 to define a high-pressure region HR (the high-pressure region HR is suitable for temporarily storing high-pressure working fluid to be discharged to the outside of the compressor), and enables the partition 119 to define a low-pressure region LR with the housing body 112 and the bottom cover 116.

The scroll compressor 100 further includes a compression mechanism CM provided in the housing 110 and is suitable for compressing a working fluid (such as a refrigerant). The compression mechanism CM may include an orbiting scroll member 150 and a non-orbiting scroll member 160.

The orbiting scroll member 150 may include: a base plate 152; a spiral orbiting scroll 154 extending upward from the upper surface of the base plate 152; and a hub 156 extending downward from the lower surface of the base plate 152.

The non-orbiting scroll member 160 may include: a base plate 162; a spiral non-orbiting scroll 164 extending downward from the lower surface of the base plate 162; an exhaust hole 166 formed at substantially the center of the base plate 162 and suitable for communicating with an exhaust cavity of the compression mechanism CM; and a recess 168 formed at substantially the center of the base plate 162, where the recess 168 is located above the exhaust hole 166 and suitable for communicating with the exhaust hole 166 and communicating with the high-pressure region HR.

The non-orbiting scroll 164 may be engaged with the orbiting scroll 154 to define a series of crescent-shaped working fluid cavities. These cavities may include: closed compression cavities undergoing compression with increasing pressure.

Wherein, an exhaust valve (such as HVE valve) 190 may be arranged in the recess 168 of the non-orbiting scroll member 160, to control the discharge of the compression mechanism CM. Specifically, referring to FIG. 2 to FIG. 3, where FIG. 2 is a partially exploded perspective view showing that an exhaust valve is arranged at an exhaust hole of a compression mechanism of a compressor in the related technology, where the exhaust valve 190 includes a valve plate 191, a valve disc 192 and a stopper 193. FIG. 3 is a partial perspective cross-sectional view after the exhaust valve is installed at the exhaust hole of the compressor shown in FIG. 2. In the early stage of operation of the compression mechanism of the compressor, the pressure in the compression cavity defined between the orbiting scroll member 150 and the non-orbiting scroll member 160 is lower than the pressure in the exhaust cavity (i.e. the high-pressure region HR), and the pressure difference between the cavities causes the exhaust valve to reside in a closed state (that is, the valve disc 192 covers and closes the valve hole of the valve plate), and then, the gas in the compression cavity is further compressed until the pressure of the compression cavity reaches the sum of the pressure of the exhaust cavity and the pressure loss, and till then the valve disc 192 is opened to discharge. As the compression mechanism continues to discharge, backflow of the gas will occur when the pressure of the compression cavity is less than the sum of the pressure of the exhaust cavity and the pressure loss, and the backflow gas will hit the valve disc 192 of the exhaust valve, causing the exhaust valve to close (i.e. the valve disc 192 covers and closes the valve hole of the valve plate 191 again). However, during the backflow of gas, since there is no buffer zone, under the action of the backflow gas hitting the valve plate and the resilience of the valve disc 192 itself, the valve disc 192 hits the valve plate at a high speed, which will generate a big impact noise and also reduce the life of the exhaust valve. Experiments have shown that compressor with an exhaust valve has a noise increase of at least 5 to 10 decibels compared with a compressor without an exhaust valve. In addition, the exhaust, backflow and exhaust of the compressor are continuously circulated, resulting in continuous noise.

In order to suppress such noise, the related conventional technology provides a muffler M at the exhaust hole (as shown in FIG. 4, which is a perspective view showing the muffler M according to the related technology). However, when the muffler M is used, only the noise in part of the entire frequency band (for example, high-frequency noise) can be suppressed. Moreover, due to the arrangement of the muffler, a pressure drop will be caused, which adversely affects the performance of the compressor and the entire refrigeration system. In addition, the additional installation of the muffler complicates the manufacturing process, increases the manufacturing cost and requires additional installation space for the muffler due to the increase in the number of components, and correspondingly degrades the operation reliability of the compressor.

SUMMARY

Technical Problem Addressed by this Disclosure

The damping apparatus of the present disclosure avoids the use of a muffler. In particular, in a compressor with an under-compressed exhaust valve, the present disclosure is able to significantly reduce the noise of the exhaust valve while maintaining or improving the exhaust performance of the compressor, and increase the service life of the exhaust valve and improve the reliability of the compressor operation.

Technical Solution

A damping apparatus for an exhaust valve in a compressor is provided according to the present disclosure. The damping apparatus includes a fixed body, and the fixed body includes an exhaust hole through which a compression cavity and an exhaust cavity are in fluid communication with each other. The exhaust hole includes an inlet, an outlet and an intermediate cavity arranged between the inlet and the outlet and allowing the inlet and the outlet to be in fluid communication with each other. The intermediate cavity is configured to enable the backflow of the gas from the exhaust cavity to form a vortex in the intermediate cavity.

Preferably, a cross-sectional area of the intermediate cavity perpendicular to a gas flow direction is greater than a cross-sectional area of the outlet perpendicular to the gas flow direction, and greater than a cross-sectional area of the inlet perpendicular to the gas flow direction.

More preferably, the cross-sectional area of the outlet perpendicular to the gas flow direction is greater than the cross-sectional area of the inlet perpendicular to the gas flow direction.

Preferably, a connecting part between the intermediate cavity and the outlet is configured to allow a gradual transition from the intermediate cavity to the outlet.

Preferably, a maximum dimension of the cross section of the intermediate cavity substantially along the gas flow direction is greater than or equal to an equivalent diameter of the inlet.

Preferably, the fixed body comprises a first half body and a second half body, the first half body includes the outlet and a first intermediate cavity, and the second half body includes the inlet and a second intermediate cavity. When the first half body and the second half body are connected, the first intermediate cavity and the second intermediate cavity cooperate to form the intermediate cavity.

Preferably, viewed from a cross section of the fixed body along the gas flow direction, the contour of the intermediate cavity is configured as a contour formed by connecting a curve, by line segment, or by a curve and a line segment.

Preferably, the intermediate cavity is a revolving cavity with a longitudinal center axis of the exhaust hole as a revolving axis.

Preferably, a lowest point of the intermediate cavity along a longitudinal center axis of the exhaust hole from the exhaust cavity towards the compression cavity extends beyond or is flush with the following plane: the plane is a plane perpendicular to the gas flow direction at the intersection of the contour of the intermediate cavity and the contour of the inlet.

An exhaust valve assembly is further provided according to the present disclosure. The exhaust valve assembly includes an exhaust valve and the damping apparatus, and the exhaust valve further includes a valve plate, a valve disc and a stopper arranged at an outlet of the exhaust hole of the damping apparatus.

A compressor is further provided according to the present disclosure, which includes the exhaust valve assembly as described above.

Preferably, the compressor is a scroll compressor. The compression mechanism of the scroll compressor includes a non-orbiting scroll member and an orbiting scroll member, a compression cavity is defined between the non-orbiting scroll member and the orbiting scroll member, and a base plate of the non-orbiting scroll member is formed as the fixed body of the damping apparatus of the exhaust valve assembly. Wherein, the exhaust hole of the damping apparatus is arranged at substantially the radial center of the base plate of the non-orbiting scroll member.

Technical Effects

According to the damping apparatus for the exhaust valve provided by the present disclosure, the beneficial effects are as follows: the gas flows back to form a vortex in the exhaust hole, thereby generating resistance, reducing the pressure difference between the exhaust cavity pressure and the compression cavity pressure, prolonging the valve closing time, and reducing the impact of the valve disc and the valve plate of the exhaust valve, so as to achieve the purpose of noise reduction; reducing the impact force and impact frequency of the valve disc is able to significantly increase the life of the valve disc, and further improve the reliability of the compressor; the use of the muffler M in conventional technology is avoided, which reduces the weight of the casting and reduces the cost.

BRIEF DESCRIPTION OF THE DRAWINGS

It will be easier to understand the features and advantages of the present disclosure by way of the specific embodiments provided in association with the accompanying drawings, wherein.

DETAILED DESCRIPTION OF THE EMBODIMENTS

Figure 1:
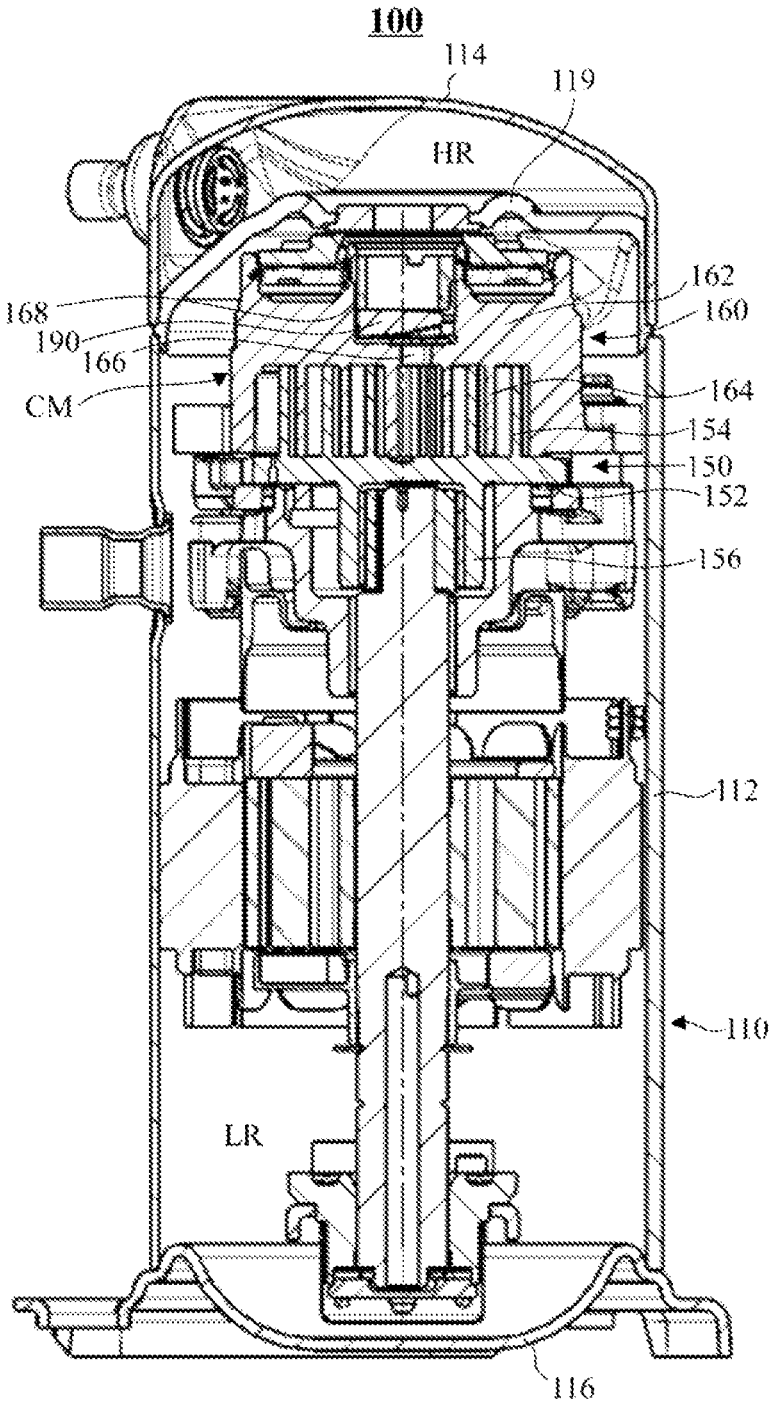
FIG. 1 is a longitudinal cross-sectional view showing a compressor provided with an exhaust valve in the related technology.
Figure 2:
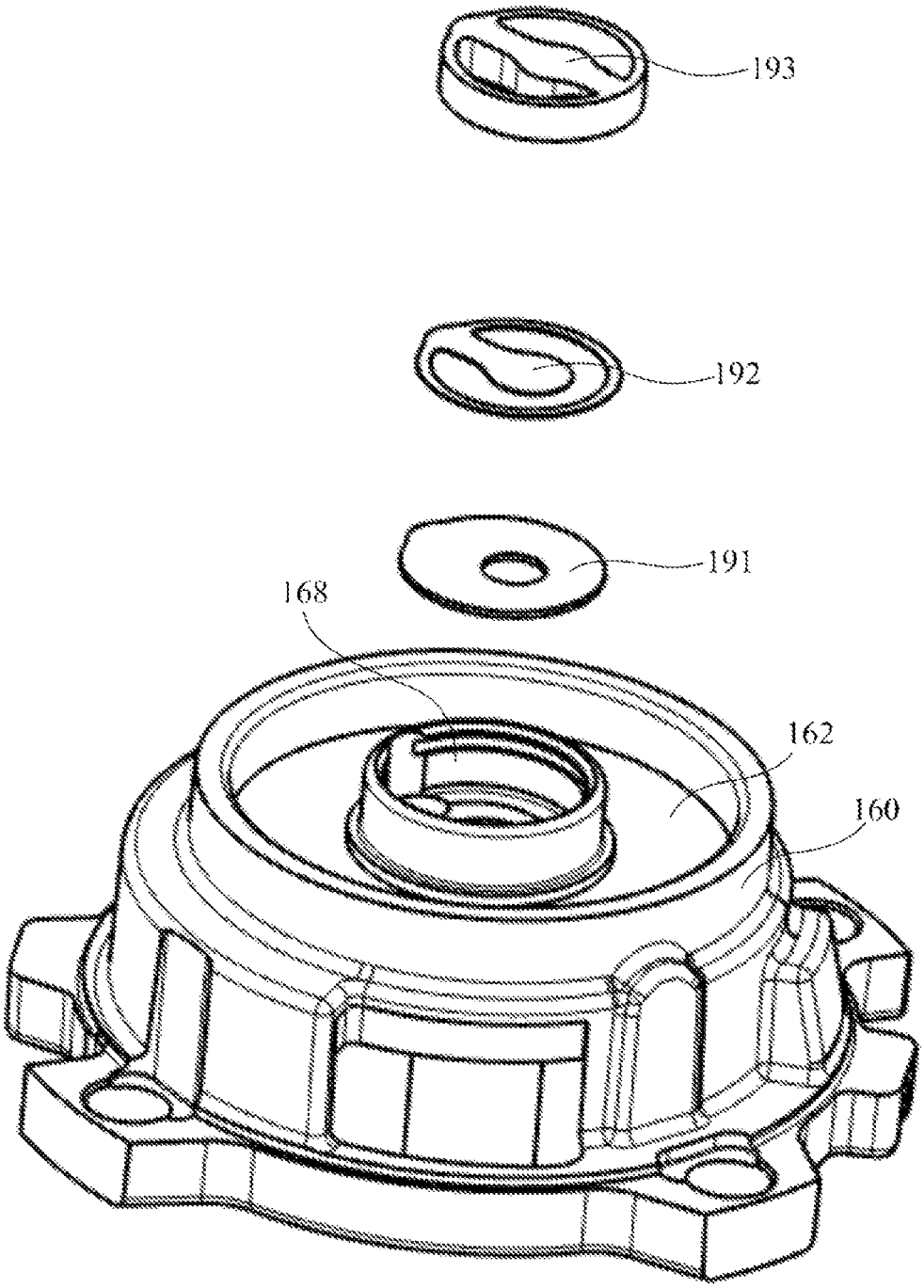
FIG. 2 is a partially exploded perspective view showing the exhaust valve arranged at an exhaust hole of a non-orbiting scroll member of the compressor of FIG. 1, where the exhaust valve includes a valve disc, a valve plate and a stopper.

The following description of the preferred embodiments is only exemplary, and is by no means a limitation to the present disclosure and its application or usage.

A damping apparatus for an exhaust valve according to an embodiment of the present disclosure will be described with reference to FIGS. 5 to 9.

The compressor involved in the embodiment in the drawings is a scroll compressor. However, it should be understood that the present disclosure is not limited to the scroll compressor, and can be applied to any suitable type of compressor. The compression mechanism of the scroll compressor includes a non-orbiting scroll member and an orbiting scroll member (not shown), a compression cavity C is defined between the non-orbiting scroll member and the orbiting scroll member, and the compression cavity C is in fluid communication with a exhaust cavity D through an exhaust hole, where the gas is compressed in the compression cavity C and then discharged into the exhaust cavity D through the exhaust hole.

Figure 3:
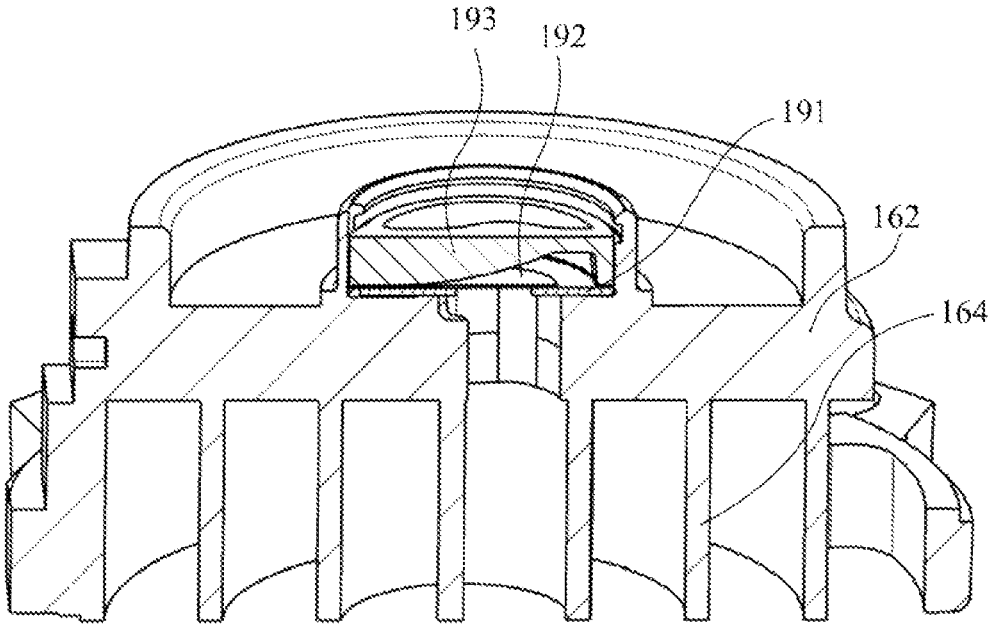
FIG. 3 is a partial perspective cross-sectional view after the exhaust valve is installed at the exhaust hole of the non-orbiting scroll member of the compressor in the related technology.
Figure 4:
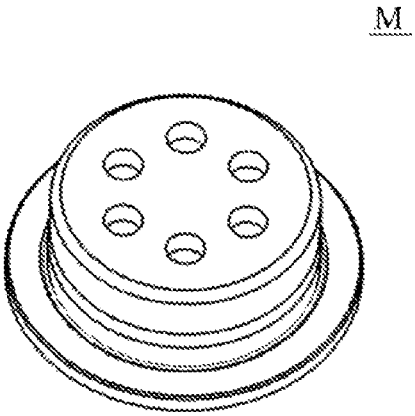
FIG. 4 is a perspective view showing a muffler for the exhaust valve in the related technology.
Figure 5:
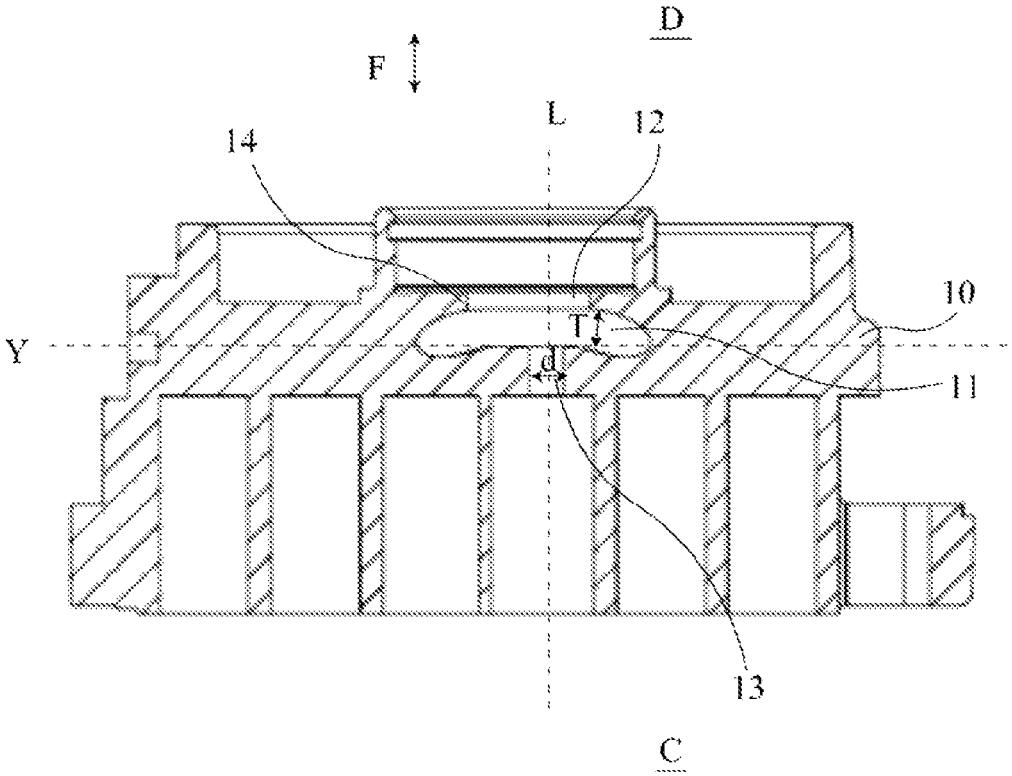
FIG. 5 is a cross-sectional view showing a damping apparatus for the exhaust valve according to an embodiment of the present disclosure, where the damping apparatus includes an exhaust hole having an inlet, an outlet and an intermediate cavity.
Figure 6:
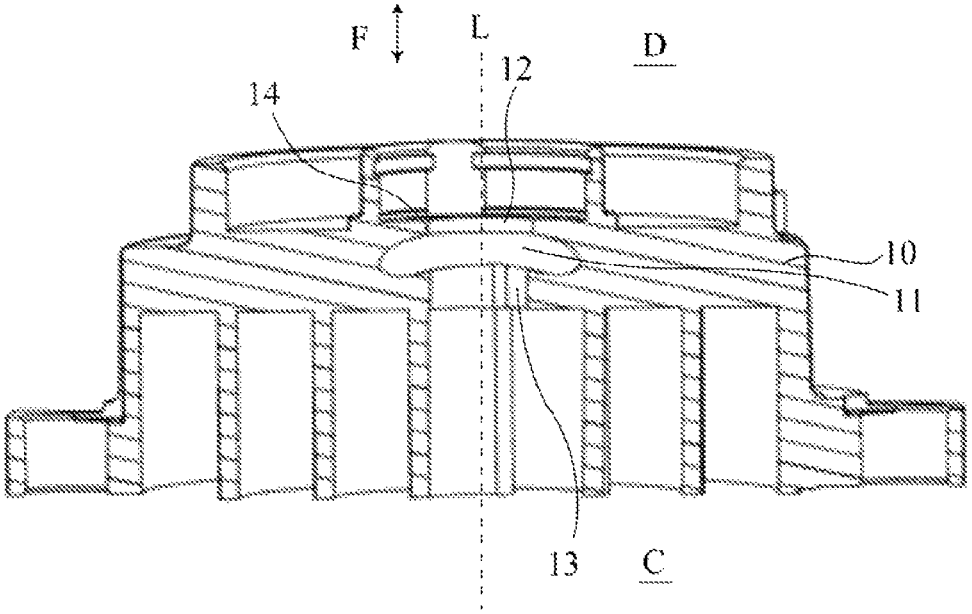
FIG. 6 is a perspective cross-sectional view showing a damping apparatus for the exhaust valve according to an embodiment of the present disclosure, where the damping apparatus includes an exhaust hole having an inlet, an outlet and an intermediate cavity.
Figure 10:
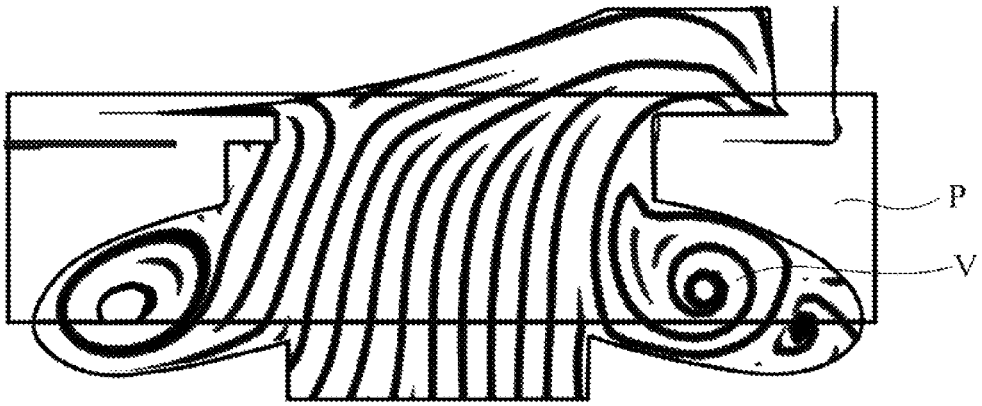
FIG. 10 is a streamline diagram showing that a vortex is formed in an exhaust hole of a compressor using the damping apparatus according to the present disclosure.

As shown in FIGS. 5 and 6, the non-orbiting scroll member of the compression mechanism of the scroll compressor includes: a base plate forming a fixed body 10, and a spiral non-orbiting scroll extending downward from the lower surface of the base plate. Among them, the fixed body 10 of the base plate is substantially disk-shaped, and an exhaust hole suitable for communicating with the exhaust cavity of the compression mechanism is provided at substantially the center of the fixed body 10. The exhaust hole includes an inlet 13, an outlet 12, and an intermediate cavity 11 provided between the inlet 13 and the outlet 12 and allowing the inlet 13 and the outlet 12 to be in fluid communication with each other. In a case that an exhaust valve is arranged at the exhaust hole of the base plate of the non-orbiting scroll member to control the exhaust of the compression mechanism, and as the compression mechanism exhausts, the pressure in the compression cavity C is lower than the sum of the pressure in the exhaust cavity D and the pressure loss and gas backflow occurs, the gas from the exhaust cavity D flows back into the intermediate cavity 11 and forms an approximate vortex V (as shown in FIG. 10). Since the gas backflow forms a strong vortex in the intermediate cavity of the exhaust hole, a large amount of energy is additionally consumed, reducing the pressure difference between the exhaust cavity pressure and the compression cavity pressure, prolonging the valve closing time, and reducing the impact between the valve disc and the valve plate of the valve, so as to achieve the purpose of noise reduction; reducing the impact force and impact frequency of the valve disc is able to significantly increase the life of the valve disc, and further improve the reliability of the compressor; and the use of the muffler M (as shown in FIG. 3) in conventional technology is avoided, which reduces the weight of the casting and reduces the cost.

That is, the non-orbiting scroll member is able to be used as a damping apparatus for the exhaust valve of a scroll compressor, where the base plate of the non-orbiting scroll member forms the fixed body of the damping apparatus. Those skilled in the art should understand that the structure of the exhaust hole of the fixed body of the damping apparatus (non-orbiting scroll member) may be applied to the fixed compression member of the compression structure of any type of compressor provided with an exhaust valve.

Figure 7:
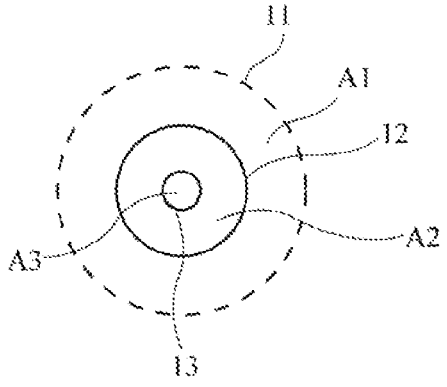
FIG. 7 is a schematic diagram showing the cross-sectional area of the respective contours of the inlet, outlet and intermediate cavity of the exhaust hole in FIG. 5 viewed from a backflow direction of the gas from the exhaust cavity, where the contour of the cross-sectional area of the intermediate cavity is represented by a dashed line.

Specifically, as shown in FIG. 7, a cross-sectional area A1 of the intermediate cavity 11 perpendicular to the gas flow direction F (shown as approximately along the longitudinal direction of the exhaust hole in the drawing) is greater than a cross-sectional area A2 of the outlet 12 perpendicular to the gas flow direction F, and greater than a cross-sectional area A3 of the inlet 13 perpendicular to the gas flow direction F. Viewed from the cross section of the fixed body 10 along the gas flow direction F, the contour of the intermediate cavity 11 may be configured as a contour formed by connecting a curve, by line segment, or by a curve and a line segment. It is conceivable to those skilled in the art that, in other aspects of the embodiment, the cross-sectional area A1 of the intermediate cavity 11 may be smaller than the cross-sectional area A2 of the outlet 12. In addition, the contour of the intermediate cavity 11 may be any shape suitable for causing the backflow of the gas to generate a vortex, for example, a funnel shape, a tapered groove, and the like.

Figure 11:
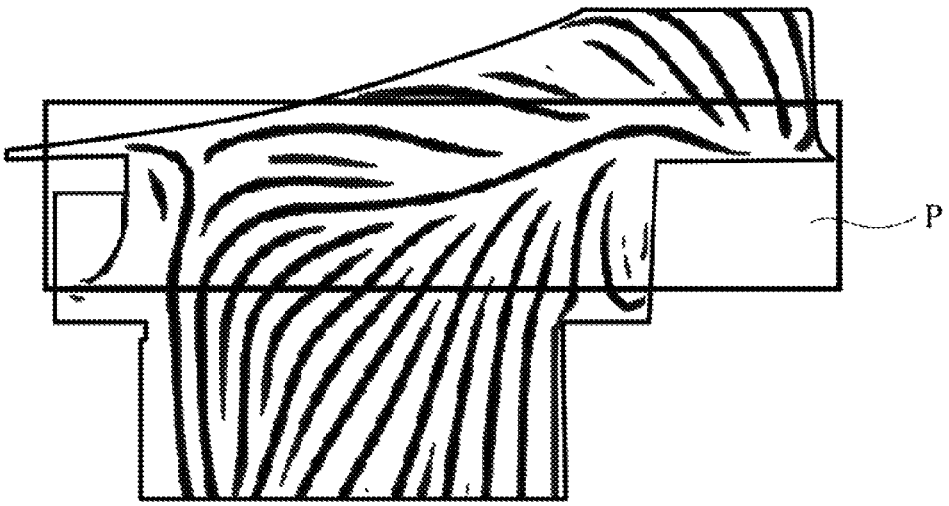
FIG. 11 is a streamline diagram showing the gas flow in the exhaust hole in the conventional technology.

Referring to FIGS. 10 and 11, zone P represents a medium pressure zone in the exhaust hole, and the structure of the exhaust hole (in particular, the intermediate cavity) of the damping apparatus (i.e. the base plate of the non-orbiting scroll member) according to the present disclosure is able to significantly increase the area of the medium pressure zone to improve distribution of the gas flow, thereby reducing the pressure difference between upper and lower sides of the valve disc and reducing the noise caused by flapping the valve disc. In addition, as shown in FIG. 10, a vortex V is generated in the intermediate cavity (radial outside). In addition, according to related experiments, during the gas backflow process of the compressor, the embodiments provided by the present disclosure are able to reduce the pressure drop between the exhaust cavity and compression cavity by about 35% compared with the related technology. Besides, in the normal exhaust process of the compressor, the pressure drop of the new design provided by the embodiment of the present disclosure only increases by 5% compared with the conventional design. That is, the use of the damping apparatus of the present disclosure is able to significantly reduce the pressure difference between the exhaust cavity pressure and the compression cavity pressure while maintaining the exhaust performance of the exhaust valve, thereby reducing the noise caused by the valve disc impact.

Still referring to FIG. 5, advantageously, the intermediate cavity 11 may be a revolving cavity (imaginary revolving forming cavity) relative to the approximately longitudinal center axis L of the exhaust hole to facilitate processing.

In addition, in this application, for the convenience of description, the direction along the longitudinal axis of the exhaust hole is defined as the height direction involving the expression of the terms "high", "low" or "height", where, the direction from the exhaust cavity toward the compression cavity along the longitudinal axis is the direction from high to low. As shown in FIG. 5, a lowest point of the intermediate cavity 11 along the longitudinal center axis L of the exhaust hole from the exhaust cavity D towards the compression cavity C extends beyond or is flush with the following plane: the plane is the plane Y perpendicular to the gas flow direction F at the intersection of the contour of the intermediate cavity 11 and the contour of the inlet 13. This makes it easier to form vortex resistance at the lowest point of the intermediate cavity to weaken the impact of the valve disc and further reduce noise. Besides, this is able to avoid the phenomenon that the exhaust performance is reduced caused by the increase of the exhaust resistance during exhaust due to the upward warping of the contour of the intermediate cavity in the exhaust direction, thereby ensuring that the exhaust performance is not affected.

Moreover, a maximum dimension T of the cross section of the intermediate cavity 11 along the gas flow direction F may be greater than the equivalent diameter d of the inlet 13 to ensure that the intermediate cavity 11 has enough space to generate vortex.

According to an aspect of an embodiment of the present disclosure, referring to FIG. 7, the cross-sectional area A2 of the outlet 12 of the exhaust hole perpendicular to the gas flow direction F is greater than the cross-sectional area A3 of the inlet 13 perpendicular to the gas flow direction F, which facilitates the exhaust from the inlet 13 to the outlet 12 through the intermediate cavity 11, thereby improving the exhaust performance. Advantageously, a connecting part 14 between the intermediate cavity 11 and the outlet 12 is provided to allow a gradual transition from the intermediate cavity 11 to the outlet 12, for example, the contour of the cross section of the connecting part along the gas flow direction F does not have an acute transition, and the gradual transition may be an arc transition or a stepped transition to further improve the exhaust performance.

Figure 9:
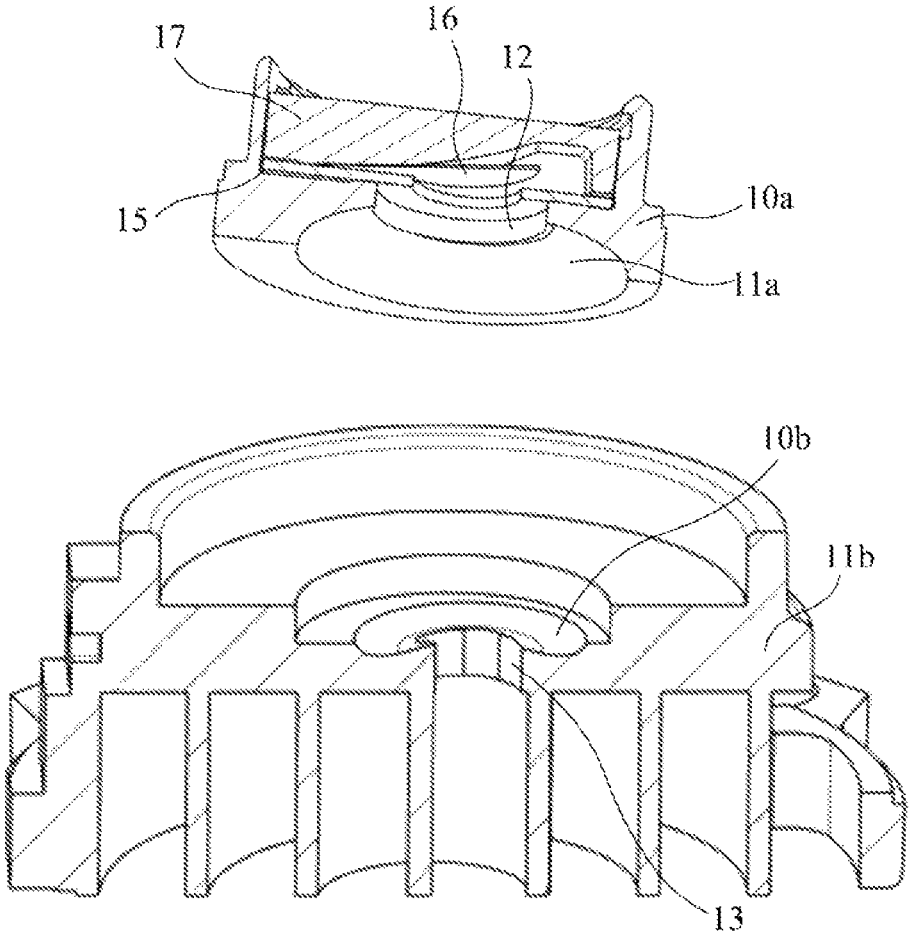
FIG. 9 is a cross-sectional view showing a damping apparatus for an exhaust valve according to another embodiment of the present disclosure, where the damping device has a split structure.

According to another aspect of the embodiment of the present disclosure, referring to FIG. 9, the fixed body 10 of the non-orbiting scroll member includes a first half body 10*a* and a second half body 10*b* in split form, and the first half body 10*a* may be connected to the second half body 10*b* through, for example, threaded connection. The first half body 10*a* includes the outlet 12 and a first intermediate cavity 11*a*, and the second half body 10*b* includes the inlet 13 and a second intermediate cavity lib, where, when the first half body 10*a* and the second half body 10*b* are connected, the first intermediate cavity 11*a* and the second intermediate cavity 11*b* cooperate to form the intermediate cavity 11. Compared with the high requirement of integral design for mold-parting of casting and machining, the split design of non-orbiting scroll member facilitates mold-parting and processing. For example, the intermediate cavity may be processed by numerical control machine tools.

Figure 8:
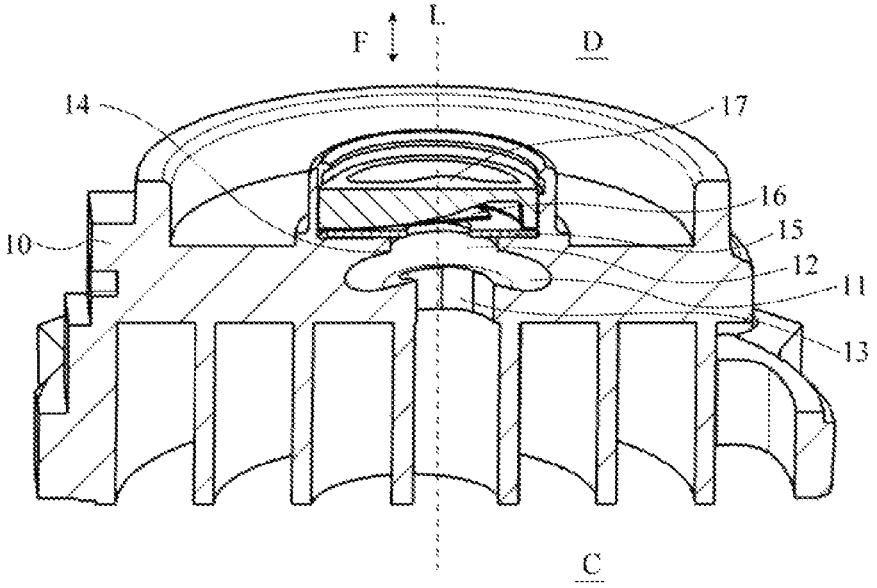
FIG. 8 is a perspective cross-sectional view showing an exhaust valve assembly including the damping apparatus of FIG. 5 according to the present disclosure.

According to another embodiment of the present disclosure, an exhaust valve assembly is provided. Referring to FIG. 8, the exhaust valve assembly includes an exhaust valve and the damping apparatus as described above, that is, the non-orbiting scroll member. The exhaust valve further includes a valve plate 15, a valve disc 16 and a stopper 17 arranged at the outlet 12 of the exhaust hole of the damping apparatus.

Although various aspects of the embodiments of the present disclosure have been described in detail herein, it should be understood that the present disclosure is not limited to the specific embodiments described and shown in detail herein, and other modifications and variations may be implemented by those skilled in the art without departing from the spirit and scope of the present disclosure. All these modifications and variations fall within the scope of the present disclosure. Moreover, all the components described herein can be replaced by other technically equivalent components.

The invention claimed is:

1. A damping apparatus for an exhaust valve in a compressor, wherein the damping apparatus comprises a fixed body, the fixed body comprises an exhaust hole through which a compression cavity and an exhaust cavity are in fluid communication with each other, the exhaust hole comprises an inlet, an outlet and an intermediate cavity arranged between the inlet and the outlet and allowing the inlet and the outlet to be in fluid communication with each other, the intermediate cavity is configured to enable a backflow of a gas from the exhaust cavity to form a vortex in the intermediate cavity, wherein a lowest point of the intermediate cavity along a longitudinal center axis of the exhaust hole from the exhaust cavity towards the compression cavity extends beyond a plane perpendicular to the gas flow direction at an intersection of the contour of the intermediate cavity and the contour of the inlet.

2. The damping apparatus for the exhaust valve in the compressor according to claim 1, wherein a cross-sectional area of the intermediate cavity perpendicular to the gas flow direction is greater than a cross-sectional area of the outlet perpendicular to the gas flow direction and greater than a cross-sectional area of the inlet perpendicular to the gas flow direction.

3. The damping apparatus for the exhaust valve in the compressor according to claim 2, wherein the cross-sectional area of the outlet is greater than the cross-sectional area of the inlet.

4. The damping apparatus for the exhaust valve in the compressor according to claim 1, wherein a connecting part between the intermediate cavity and the outlet is configured to allow a gradual transition from the intermediate cavity to the outlet.

5. The damping apparatus for the exhaust valve in the compressor according to claim 1, wherein a maximum dimension of the cross section of the intermediate cavity substantially along the gas flow direction is greater than or equal to an equivalent diameter of the inlet.

6. The damping apparatus for the exhaust valve in the compressor according to claim 1, wherein the fixed body comprises a first half body and a second half body in split form, the first half body comprises the outlet and a first intermediate cavity, the second half body comprises the inlet and a second intermediate cavity, wherein, when the first half body and the second half body are connected, the first intermediate cavity and the second intermediate cavity cooperate to form the intermediate cavity.

7. The damping apparatus for the exhaust valve in the compressor according to claim 1, wherein when viewed from a cross section of the fixed body along the gas flow direction, the contour of the intermediate cavity is configured as a contour formed by a curve, by line segment, or by a curve and a line segment.

8. The damping apparatus for the exhaust valve in the compressor according to claim1, wherein the intermediate cavity is a revolving cavity with the longitudinal center axis of the exhaust hole as a revolving axis.

9. An exhaust valve assembly, wherein the exhaust valve assembly comprises an exhaust valve and the damping apparatus according to claim 1, the exhaust valve comprises a valve plate, a valve disc and a stopper arranged at the outlet of the exhaust hole of the damping apparatus.

10. A compressor, wherein the compressor comprises the exhaust valve assembly according to claim 9.

11. The compressor according to claim 10, wherein the compressor is a scroll compressor, a compression mechanism of the scroll compressor comprises a non-orbiting scroll member and an orbiting scroll member, the compression cavity is defined between the non-orbiting scroll member and the orbiting scroll member, a base plate of the non-orbiting scroll member is formed as the fixed body of the damping apparatus of the exhaust valve assembly, wherein the exhaust hole of the damping apparatus is arranged at substantially the radial center of the base plate of the non-orbiting scroll member.

* * * * *